US009895037B1

(12) United States Patent
Shelar

(10) Patent No.: US 9,895,037 B1
(45) Date of Patent: Feb. 20, 2018

(54) BATHROOM HYGIENE DEVICE

(71) Applicant: Yatin Shelar, Naples, FL (US)

(72) Inventor: Yatin Shelar, Naples, FL (US)

( * ) Notice: Subject to any disclaimer, the term of this patent is extended or adjusted under 35 U.S.C. 154(b) by 0 days.

(21) Appl. No.: 15/334,261

(22) Filed: Oct. 25, 2016

(51) Int. Cl.
*A47K 17/00* (2006.01)
*A47K 17/02* (2006.01)

(52) U.S. Cl.
CPC ..... *A47K 17/02* (2013.01)

(58) Field of Classification Search
CPC ..... A47K 17/02; A47K 17/028; A47K 17/00; A47K 17/003
USPC ..... 4/661, 300.3; 604/356
See application file for complete search history.

(56) References Cited

U.S. PATENT DOCUMENTS 1,867,506 A * 7/1932 Grypma ..... A47K 17/003 4/244.2
2,187,676 A * 1/1940 Biewen ..... A47G 27/0225 15/215
2,189,562 A * 2/1940 Doerr ..... A47K 17/003 4/245.8
2,934,249 A * 4/1960 Zajfman ..... A47K 17/003 225/47
4,662,009 A * 5/1987 Hefty ..... A47K 13/145 4/243.2
4,760,613 A * 8/1988 Bobak ..... A47K 13/145 4/237
4,935,969 A * 6/1990 Farnsworth ..... A47K 13/16 4/245.4
5,168,586 A * 12/1992 Small ..... A47K 3/281 141/364
5,680,978 A * 10/1997 Pinion ..... B65D 85/672 220/230
6,174,581 B1 * 1/2001 Barker ..... A47K 17/00 4/251.1
D658,920 S * 5/2012 Porter ..... D6/583
8,291,526 B2 * 10/2012 Parvizian ..... A47C 16/02 297/423.1
8,607,369 B1 * 12/2013 Al-Khattaf ..... A47K 17/02 4/254
2005/0008853 A1 * 1/2005 Foote ..... A01K 1/0107 428/343
2005/0022298 A1 * 2/2005 de Leon ..... A47G 27/0225 4/661
2005/0223488 A1 * 10/2005 Amorin ..... A47G 27/0225 4/661
2005/0223489 A1 * 10/2005 Amorin ..... A47K 17/02 4/661
2008/0034485 A1 * 2/2008 McClelland ..... A47K 17/00 4/300

(Continued)

*Primary Examiner* — J. Casimer Jacyna
*Assistant Examiner* — Benjamin R Shaw
(74) *Attorney, Agent, or Firm* — Mark Terry

(57) ABSTRACT

An apparatus for reducing or eliminating splattering of fluid at a urinal or toilet is disclosed. The apparatus includes a tray adjacent to the urinal or toilet, foot rests on either side of the tray, a splatter guard comprising an enclosure located on top of the tray, wherein an open end of the splatter guard faces the urinal or toilet, and a closed end of the splatter guard faces the individual, and wherein the splatter guard prevents splattering of liquid falling from the urinal or toilet, a disposable and absorbent pad configured for placement in the tray such that the pad absorbs liquid falling from the urinal or toilet and, a disposable and water repellant cover configured for placement over and on top of the splatter guard.

9 Claims, 21 Drawing Sheets

(56) References Cited

U.S. PATENT DOCUMENTS

| | | | | |
|---|---|---|---|---|
| 2014/0007333 | A1* | 1/2014 | DeFlorio | E03D 13/005 4/254 |
| 2015/0322658 | A1* | 11/2015 | Sikirov | E03D 11/025 4/420 |
| 2017/0099973 | A1* | 4/2017 | Chao | A47G 27/0206 |

* cited by examiner

BATHROOM HYGIENE DEVICE

CROSS-REFERENCE TO RELATED APPLICATIONS

Not Applicable

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The technical field relates generally to human hygiene and, more specifically, to devices and processes for improving hygiene in bathrooms.

BACKGROUND

Bathrooms, especially public bathrooms, are the subject of many efforts to increase hygiene. This is because bathrooms are known to be vehicles that spread diseases and other afflictions among individuals. Also, many individuals strive to achieve a high level of cleanliness and sanitation for aesthetic reasons. Urinals and toilets, in particular, are the source of considerable untidiness because of the fluid nature of urine and other bodily fluids. It is common for urine, for example, to splash or otherwise splatter in different directions when the urine lands on a urinal or toilet. Often, this results in urine landing and accumulating on the floor surrounding the toilet or urinal. In bathrooms that experience heavy use, such as bathrooms in airports, bus stations, railway stations, schools, government and private office facilities, athletic facilities, swimming pools, bars, hotels, restaurants, gas stations, or nightclubs, etc., the accumulation of urine on the floor can increase to large and unpleasant amounts. Often, users of said bathrooms are forced to stand in said accumulated urine when using the toilets and urinals. Upon finishing use of the toilet or urinal, the user then tracks urine within the bathroom and even areas outside the bathroom. The accumulation of urine on bathroom floors is therefore untidy, displeasing and unsavory to bathrooms users. This situation can also be unhygienic, as urine can spread disease. Two well-known diseases that can be spread through urine include typhoid and urinary schistosomiasis. Further, the accumulation of urine on bathroom floors can be difficult and time-consuming to clean for bathroom cleaning staff. This increases janitorial costs, as well as the risk of infection by said bathroom cleaning staff.

Therefore, a need exists for improvements over the prior art, and more particularly for devices and processes for improving hygiene in bathrooms.

SUMMARY

An apparatus for reducing or eliminating splattering of fluid at a urinal or toilet is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, the apparatus includes a roll of absorbent material configured for absorbing liquid falling from the person urinating and the urinal or toilet, a first roller configured for accepting the roll of absorbent material and for rotating when pulled, so as to expel absorbent material out of the roll, a second mechanized roller configured for rotating upon command, so as to accept and wind up absorbent material expelled from the roll, a middle planar element located between the first roller and the second mechanized roller, wherein the middle planar element is located adjacent to the urinal or toilet so as to catch liquid falling from the urinal or toilet, wherein the absorbent material expelled from the first roller is located on top of the middle planar element, and wherein the middle planar element is configured to support the weight of an individual utilizing the urinal or toilet, a splatter guard comprising an enclosure located on top of the middle planar element, wherein an open end of the splatter guard faces the urinal or toilet, and a closed end of the splatter guard faces the individual, and wherein the splatter guard prevents splattering of liquid falling from the person urinating or the urinal or toilet onto the individual, a sensor for sensing proximity of said individual, and, a processor configured for receiving a signal from the sensor sensing proximity of said individual, and activating the second mechanized roller to advance the roll of absorbent material to place a fresh segment of absorbent material from the roll on top of the middle planar element.

In another embodiment, the apparatus includes a tray having a distal end located adjacent to the urinal or toilet, and a proximal end located adjacent to an individual utilizing the urinal or toilet, a foot rest located on the left side of the tray, a foot rest located on the right side of the tray, a splatter guard comprising an enclosure located on top of the tray, wherein an open end of the splatter guard faces the urinal or toilet, and a closed end of the splatter guard faces the individual, and wherein the splatter guard prevents splattering of liquid falling from the urinal or toilet onto the individual and the foot rests, a disposable and absorbent pad configured for placement in the tray such that the pad absorbs liquid falling from the urinal or toilet onto the tray, and, a disposable and water repellant cover configured for placement over and on top of the splatter guard, such that the cover prevents liquid falling from the urinal or toilet from contacting the splatter guard.

BRIEF DESCRIPTION OF THE DRAWINGS

The claimed subject matter is particularly pointed out and distinctly claimed in the claims at the conclusion of the specification. The foregoing and other features and also the advantages of the claimed subject matter will be apparent from the following detailed description taken in conjunction with the accompanying drawings. Additionally, the left most digit of a reference number may identify the drawing in which the reference number first appears. The accompanying drawings, which are incorporated in and constitute a part of this disclosure, illustrate various example embodiments. In the drawings:

DETAILED DESCRIPTION

Figure 1:
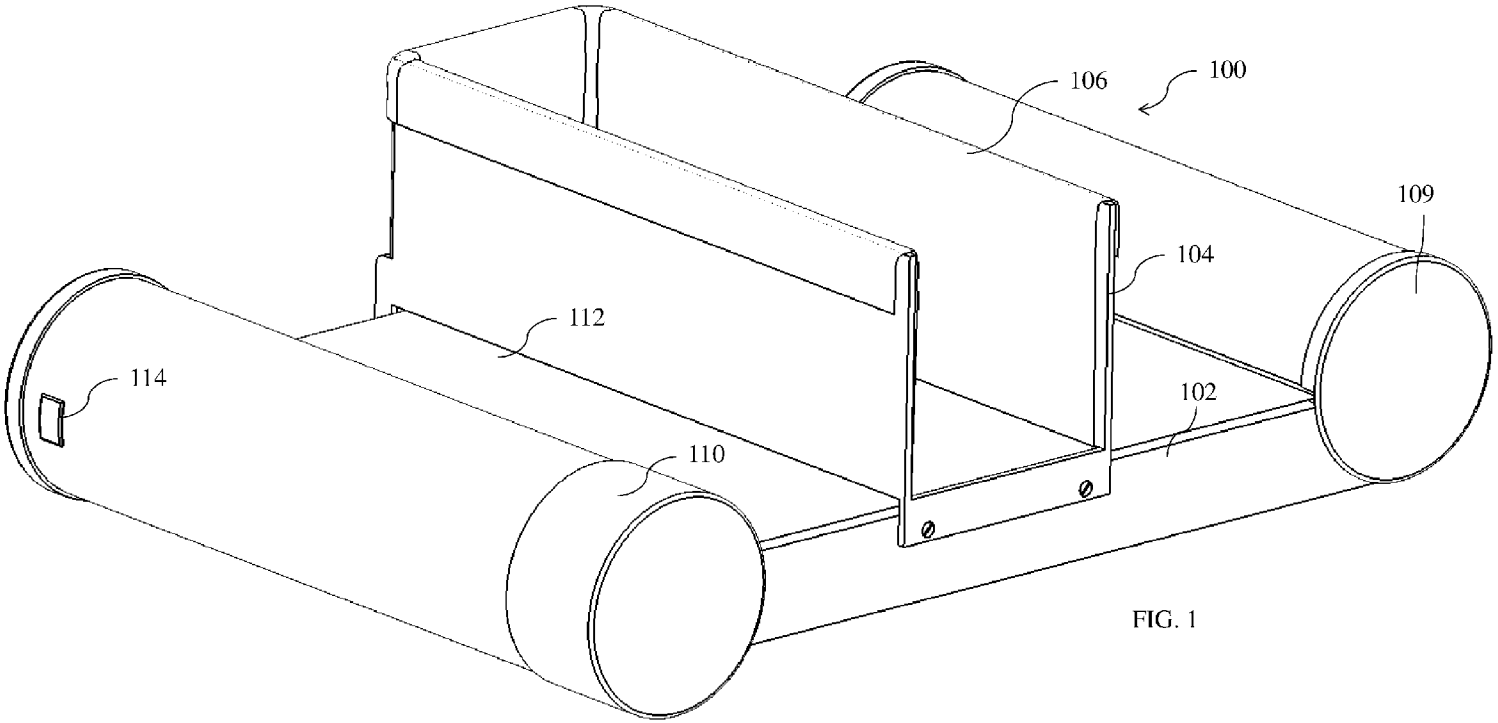
FIG. 1 is a frontal perspective view of the bathroom hygiene device, according to a first example embodiment.

The following detailed description refers to the accompanying drawings. Wherever possible, the same reference numbers are used in the drawings and the following description to refer to the same or similar elements. While embodiments may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The disclosed embodiments improve over the prior art by providing a simple and easy-to-use apparatus that captures splashing or splattering urine underneath a toilet or urinal. This reduces or eliminates the accumulation of urine on the bathroom floor around toilets and urinals, as well as splattering of urine on a bathroom user. The features of the disclosed embodiments further decrease the cost of janitorial services required to clean up the accumulation of urine on the bathroom floor around toilets and urinals. The disclosed embodiments also reduce or eliminate odor and damage to the flooring. The disclosed embodiments also improve over the prior art by providing a simplified mechanism for servicing the area around urinals and toilets. This reduces or eliminates the chances of spreading urine and diseases among users of toilets and urinals, as well as the janitorial staff.

Figure 11:
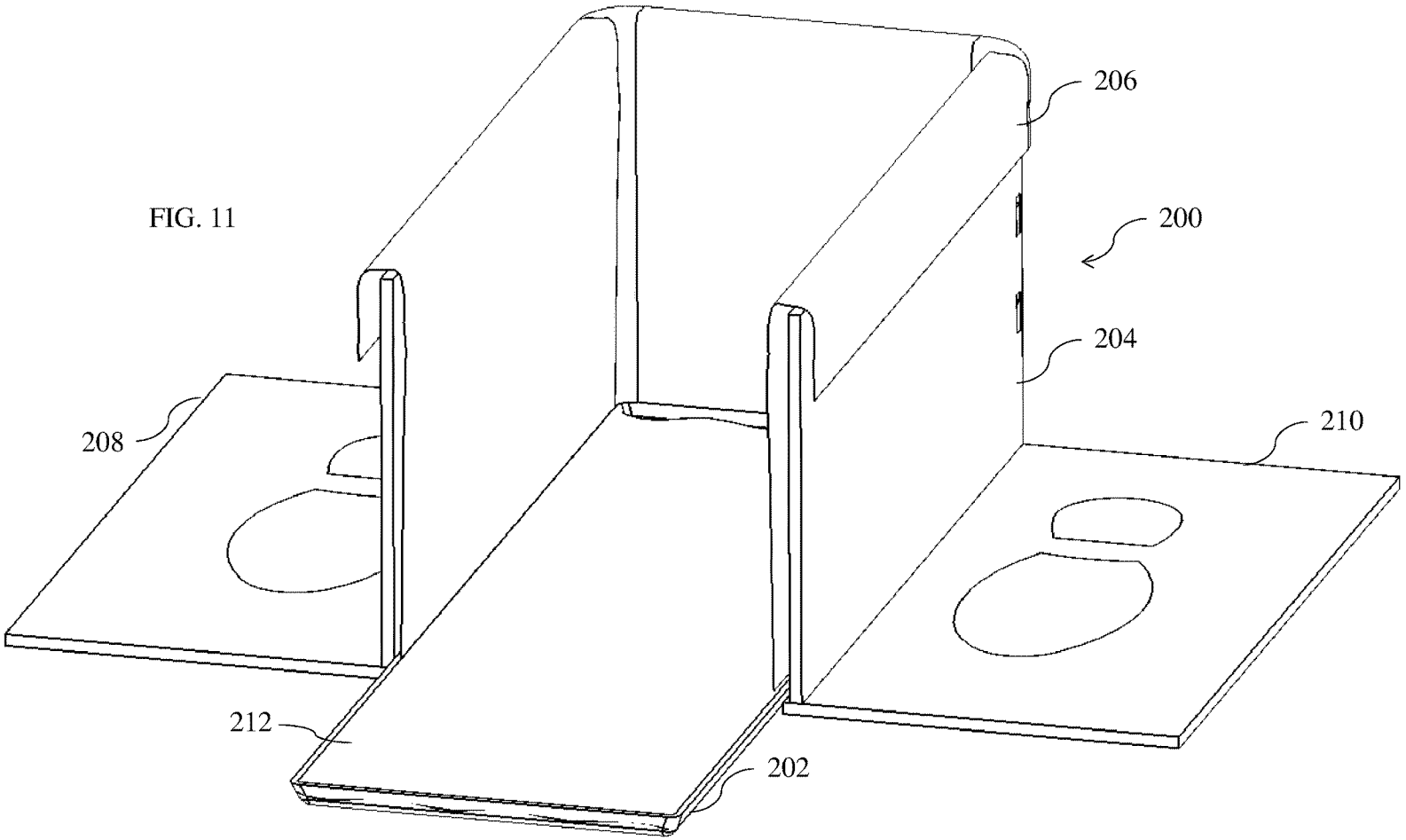
FIG. 11 is a frontal perspective view of the bathroom hygiene device, according to a second example embodiment.

FIG. 11 is a frontal perspective view of the bathroom hygiene device 200, according to a second example embodiment. FIG. 11 shows that the device 200 includes a tray 202 having a distal end located adjacent to the urinal or toilet, and a proximal end located adjacent to an individual utilizing the urinal or toilet, a foot rest 208 located on the left side of the tray, a foot rest 210 located on the right side of the tray, a splatter guard 204 comprising an enclosure located on top of the tray, wherein an open end of the splatter guard faces the urinal or toilet, and a closed end of the splatter guard faces the individual, and wherein the splatter guard 204 prevents splattering of liquid falling from the urinal or toilet onto the individual and the foot rests, a disposable and absorbent pad 212 configured for placement in the tray such that the pad absorbs liquid falling from the urinal or toilet onto the tray, and a disposable and water repellant cover 206 configured for placement over and on top of the splatter guard, such that the cover prevents liquid falling from the urinal or toilet from contacting the splatter guard 204.

Figure 12:
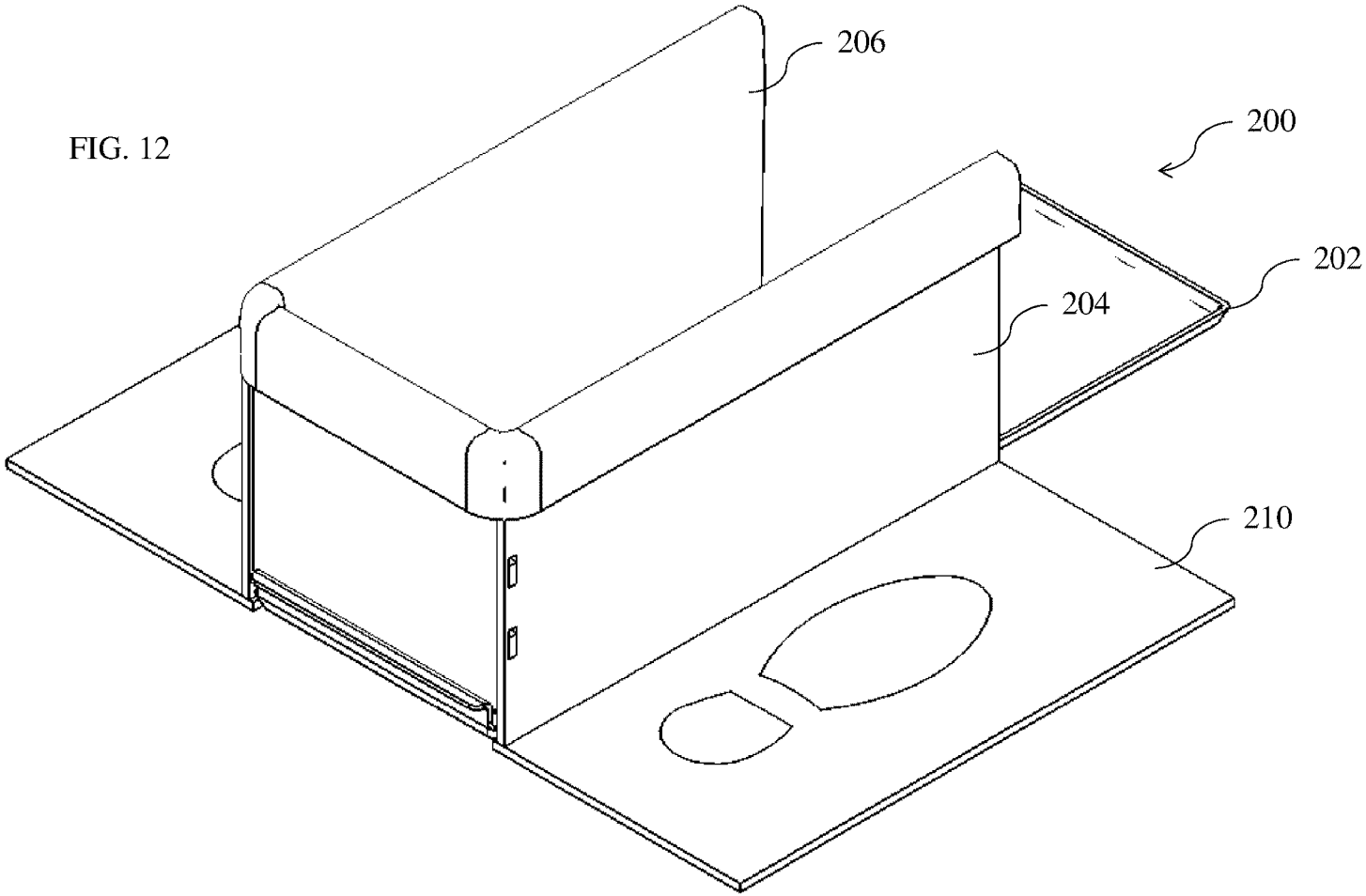
FIG. 12 is a rear perspective view of the bathroom hygiene device, according to the second example embodiment.

FIG. 12 is a rear perspective view of the bathroom hygiene device 200, according to the second example embodiment. FIG. 12 shows how the disposable and water repellant cover 206 is configured for placement over and on top of the splatter guard 204.

Figure 13:
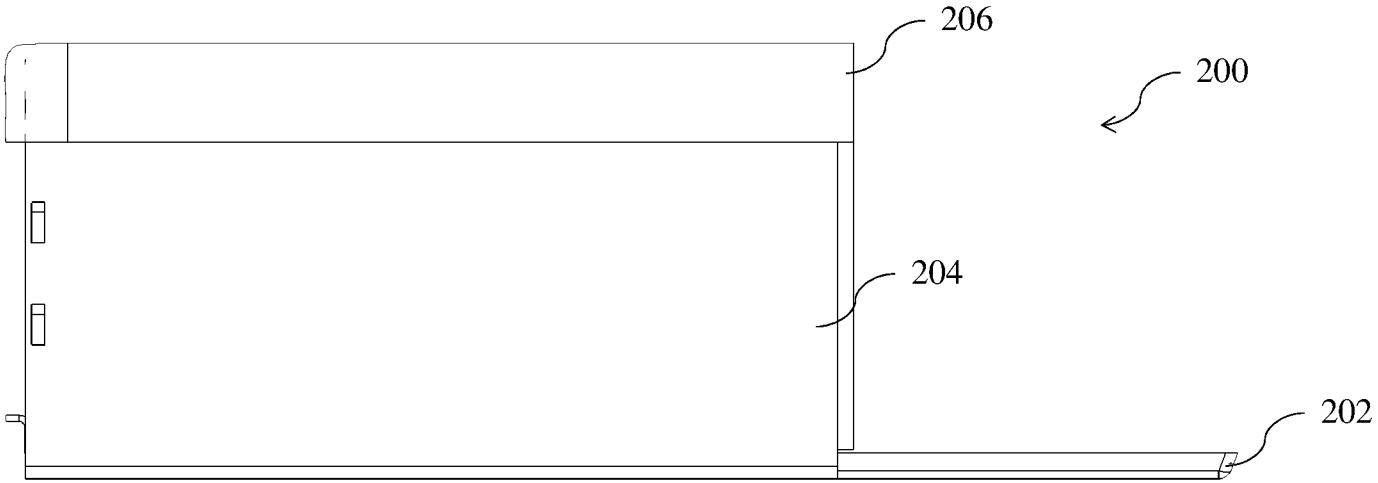
FIG. 13 is a side view of the bathroom hygiene device, according to the second example embodiment.

FIG. 13 is a side view of the bathroom hygiene device 200, according to the second example embodiment. FIG. 13 shows how the tray 202 has a distal end located adjacent to the urinal or toilet, and a proximal end located adjacent to an individual utilizing the urinal or toilet. The tray 202 extends outwards away from the splatter guard 204 so as to aid in capturing fluid falling from the urinal or toilet.

Figure 14:
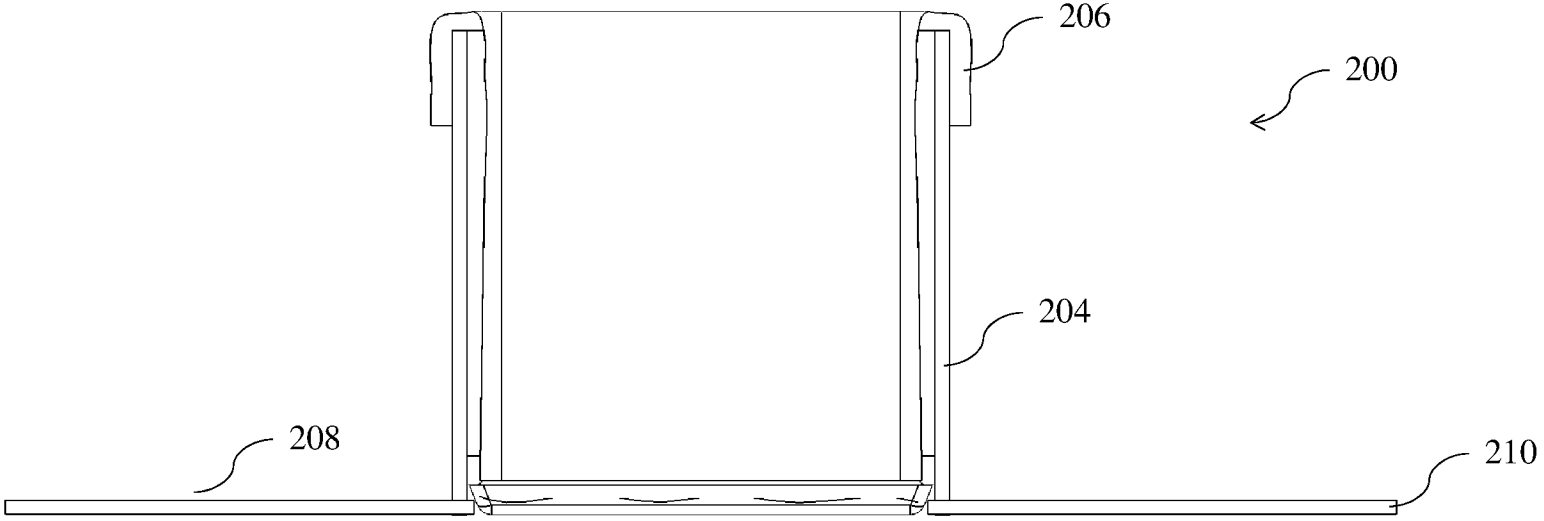
FIG. 14 is a frontal view of the bathroom hygiene device, according to the second example embodiment.

FIG. 14 is a frontal view of the bathroom hygiene device 200, according to the second example embodiment. FIG. 14 shows how the foot rest 208 is located on the left side of the tray 202, and foot rest 210 is located on the right side of the tray 202.

Figure 15:
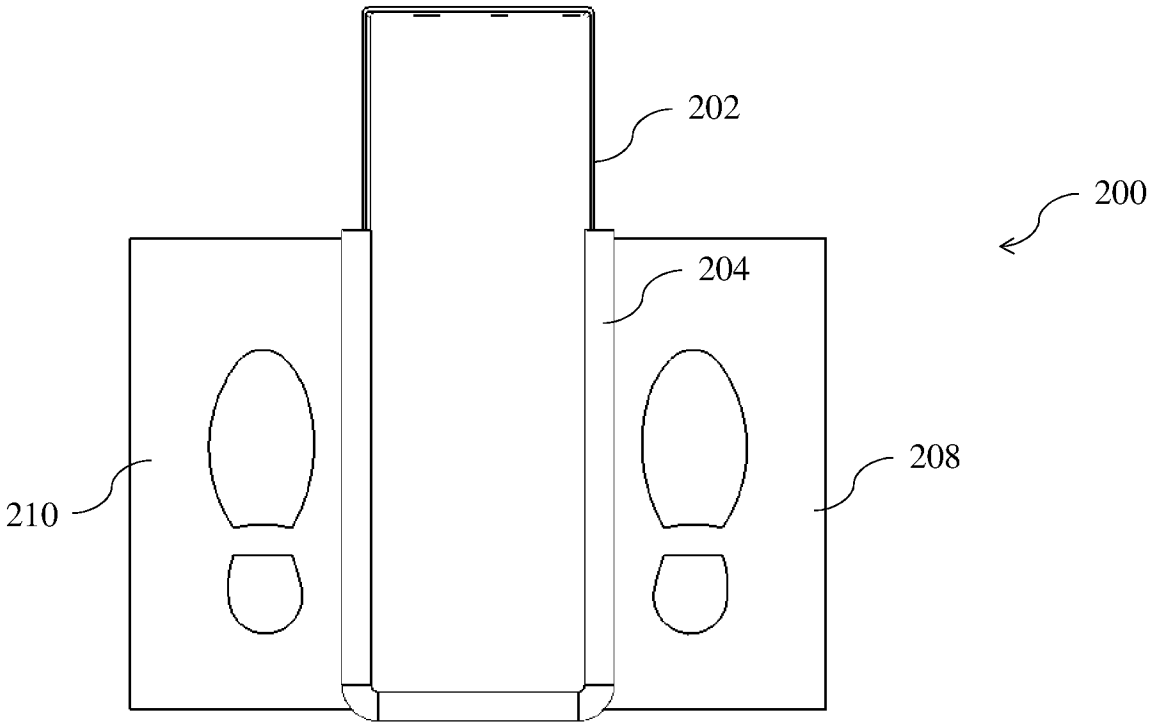
FIG. 15 is a top view of the main receptacle of the bathroom hygiene device, according to the second example embodiment.

FIG. 15 is a top view of the bathroom hygiene device 200, according to the second example embodiment. FIG. 15 shows how tray 202 extends outwards away from the splatter guard 204 so as to aid in capturing fluid falling from the urinal or toilet.

Figure 16:
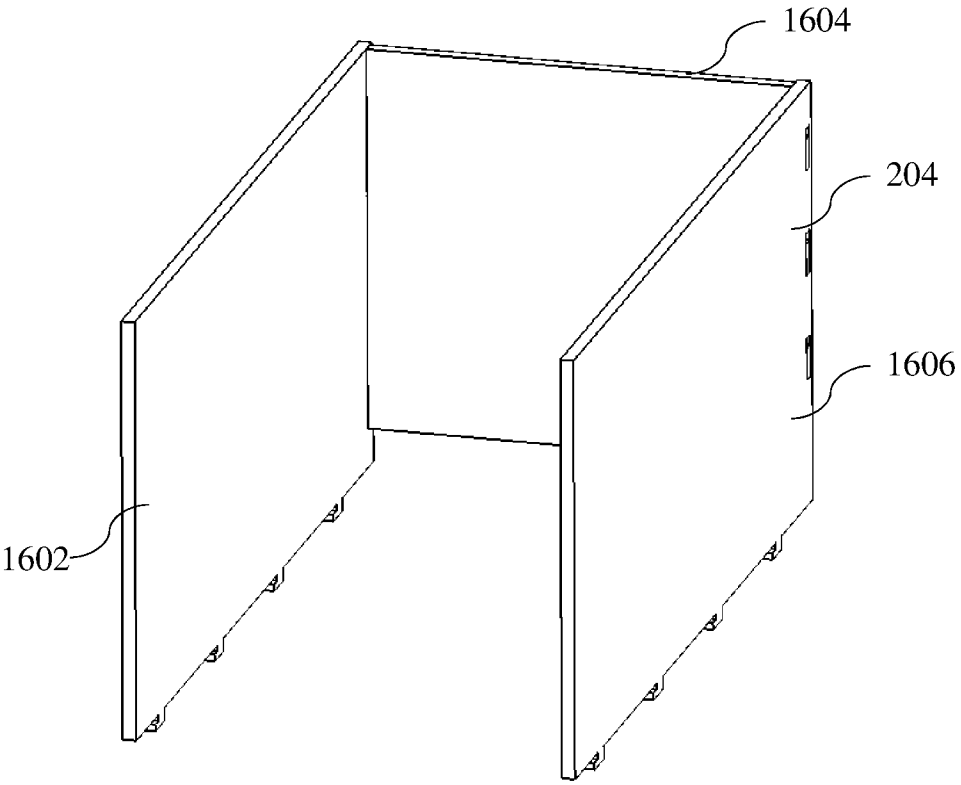
FIG. 16 is a frontal perspective view of the splatter guard of the bathroom hygiene device, according to the second example embodiment.

FIG. 16 is a frontal perspective view of the main receptacle or splatter guard 204 of the bathroom hygiene device 200, according to the second example embodiment. FIG. 16 shows that the splatter guard 204 comprises three, upright rectangular walls 1602, 1604, and 1606 connected in a general U-shape, wherein an open end of the splatter guard faces the urinal or toilet, and a closed end of the splatter guard faces the individual.

Figure 17:
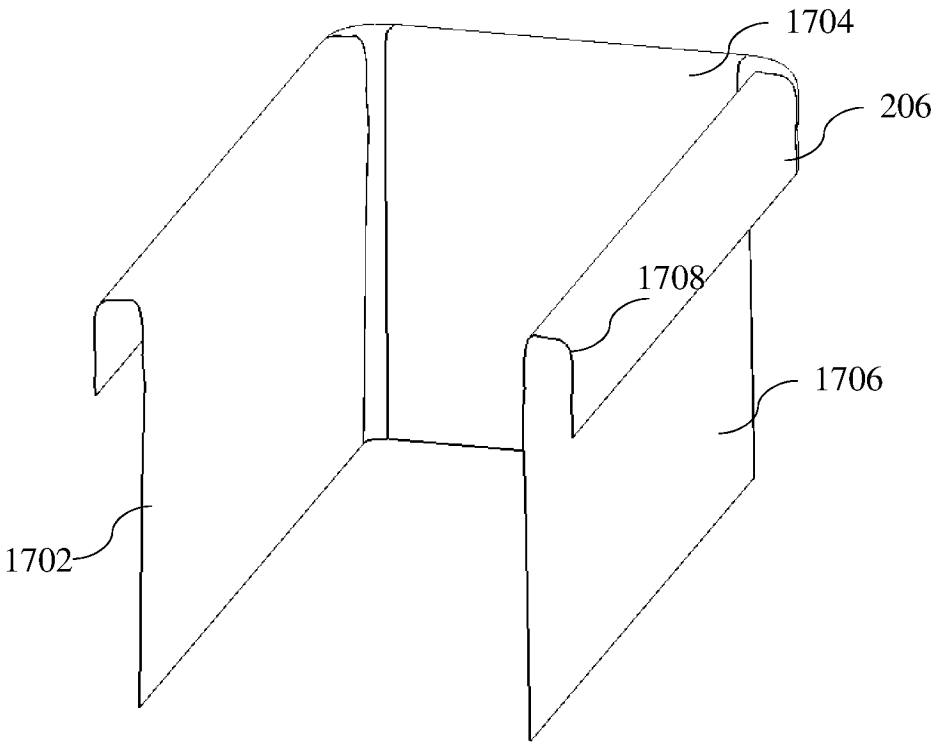
FIG. 17 is a frontal perspective view of the disposable cover for the main receptacle of the bathroom hygiene device, according to the second example embodiment.

FIG. 17 is a frontal perspective view of the disposable and water repellant cover 206 for the main receptacle or splatter guard 204 of the bathroom hygiene device 200, according to the second example embodiment. FIG. 17 shows that the cover 206 comprises three, upright rectangular walls 1702, 1704, and 1706 connected in a general U-shape, wherein an open end of the cover faces the urinal or toilet, and a closed end of the cover faces the individual. The cover 206 is configured to fit securely over and on top of the splatter guard 204. The cover 206 also includes a lip 1708 that curves away from the brim of the three, upright rectangular walls 1702, 1704, 1706 so as to completely cover the splatter guard 204 and prevent it from being contacted by fluid falling from the urinal or toilet.

Figure 18:
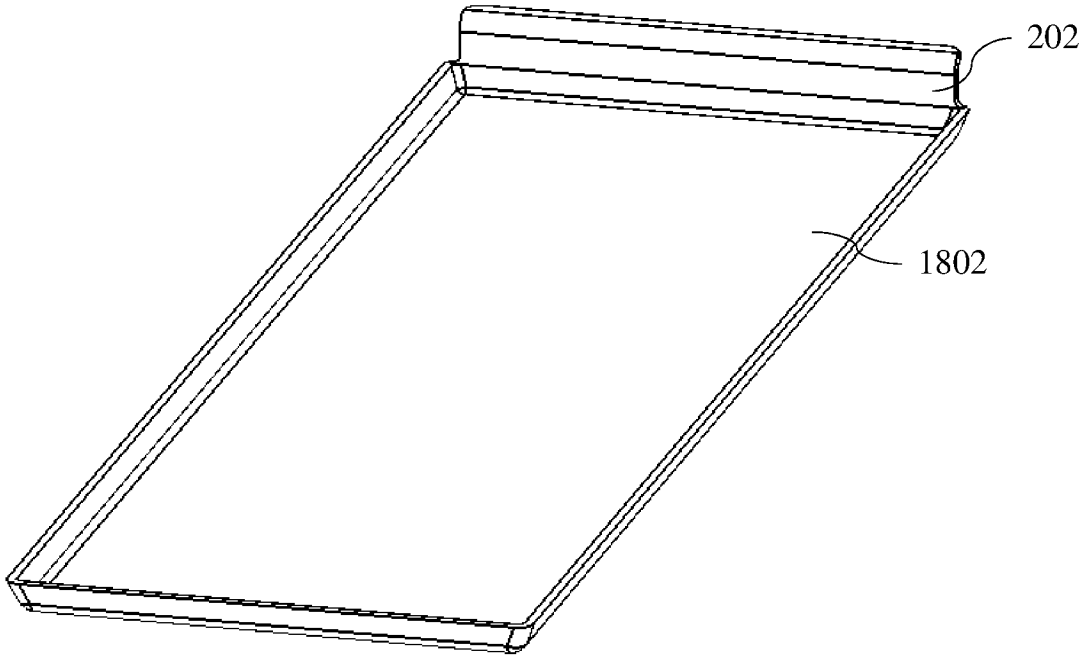
FIG. 18 is a frontal perspective view of the lower receptacle for the bathroom hygiene device, according to the second example embodiment.

FIG. 18 is a frontal perspective view of the lower receptacle or tray 202 for the bathroom hygiene device 200, according to the second example embodiment. The tray 202 comprises a rectangular shape 1802 with four raised sides.

Figure 19:
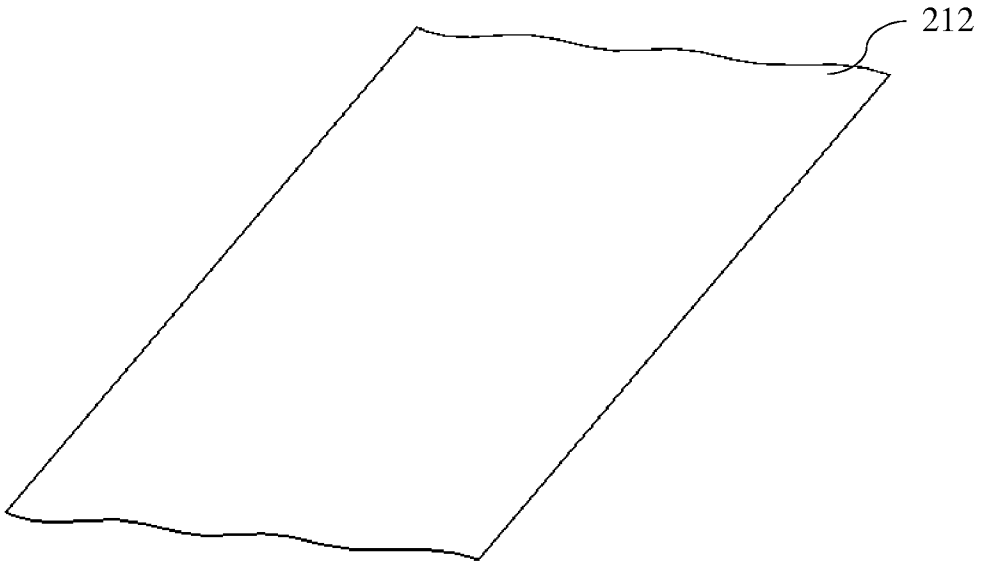
FIG. 19 is a frontal perspective view of the disposable absorbent sheet for the lower receptacle of the bathroom hygiene device, according to the second example embodiment.

FIG. 19 is a frontal perspective view of the absorbent pad or sheet 212 for the lower receptacle or tray 202 of the bathroom hygiene device 200, according to the second example embodiment. The absorbent pad or sheet 212 comprises a rectangular shape. The disposable and absorbent pad or sheet comprises a rectangular shape configured for placement within the rectangular shape of the tray 202, such that a bottom of the tray 202 is completely covered by the pad or sheet.

Figure 20:
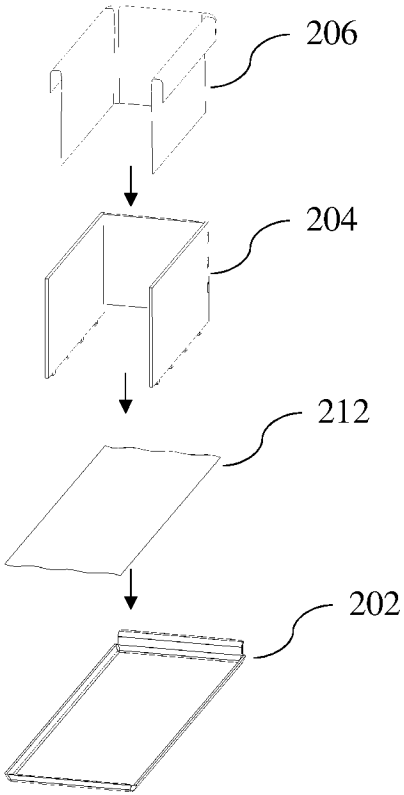
FIG. 20 is a frontal perspective exploded view of the bathroom hygiene device, according to the second example embodiment.

FIG. 20 is a frontal perspective exploded view of the bathroom hygiene device 200, according to the second example embodiment. FIG. 20 shows how the cover 206 is placed on top of and over the splatter guard 204, which is placed on top of the tray 202. The absorbent sheet 212 is placed in the lower receptacle or tray 202.

Figure 21:
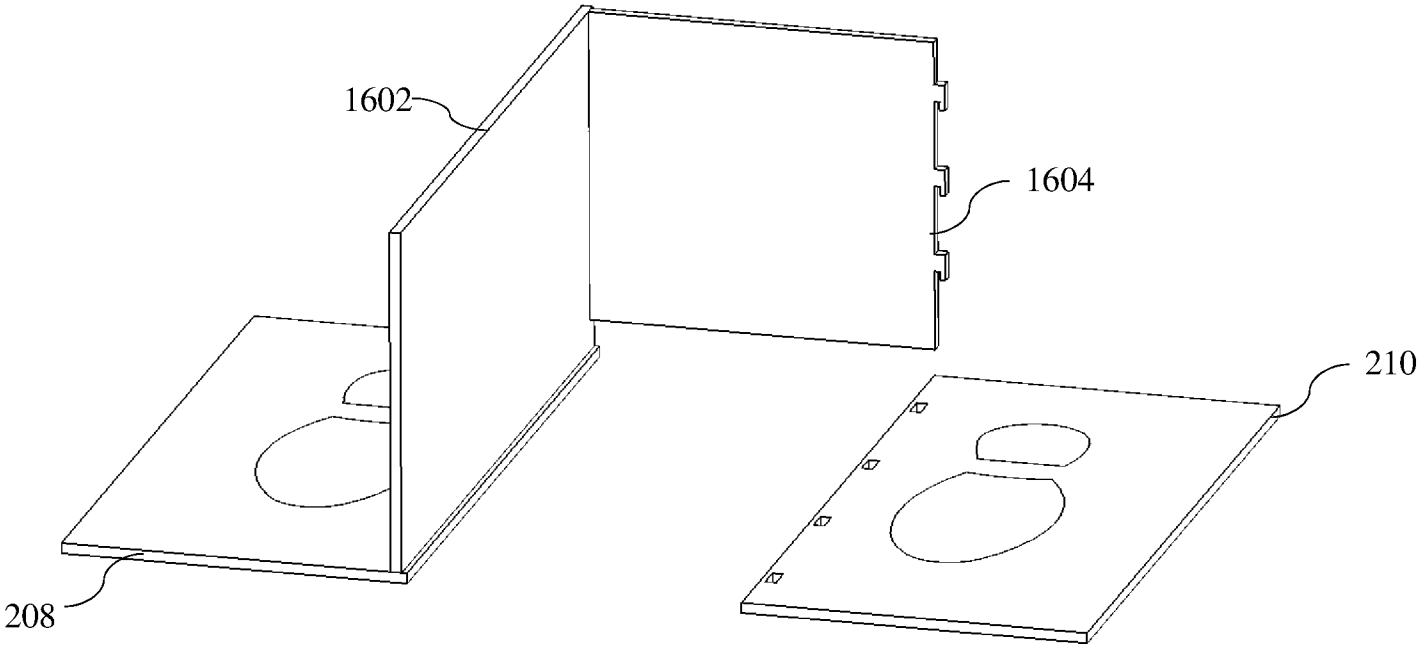
FIG. 21 is a frontal perspective view of various components of the bathroom hygiene device, according to the second example embodiment

FIG. 21 is a frontal perspective view of various components of the bathroom hygiene device 200, according to the second example embodiment. FIG. 21 shows the splatter guard 204 in a state of disassembly, showing upright rectangular walls 1602, 1604 connected using general tongue and groove features on the ends of the walls. FIG. 21 also shows that foot rests 208 and 210 can be coupled with the upright rectangular walls 1602, 1604 using general tongue and groove features on the ends of the foot rests 208 and 210. Foot rests 208 and 210 may comprise rectangular planar elements including an image of a foot disposed thereon. Foot rests 208 and 210 may also comprise a non-skid bottom and a non-skid top to stand on, so as to provide added security to the device and the person standing on it.

Figure 22:
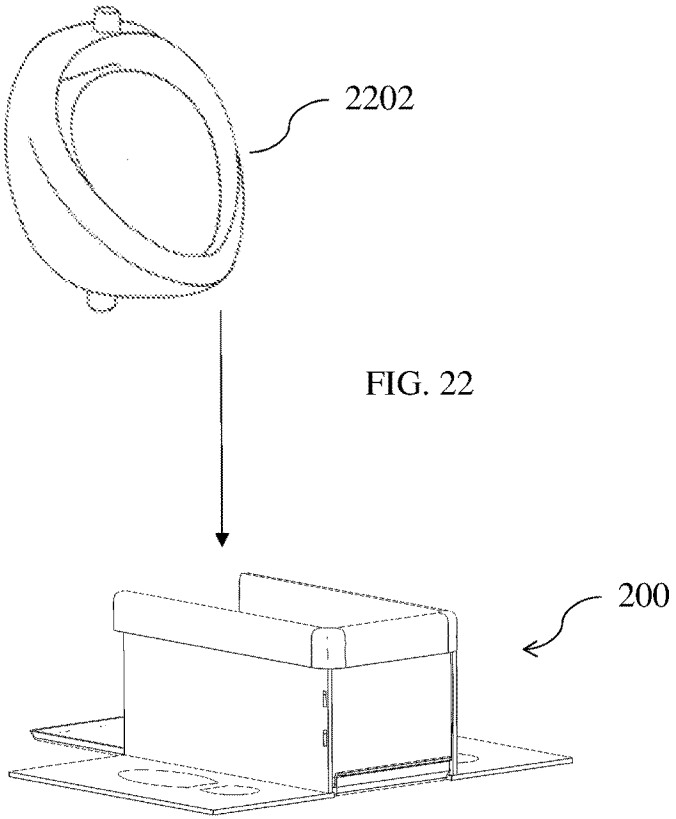
FIG. 22 is a rear perspective view of the bathroom hygiene device used in conjunction with a urinal, according to the second example embodiment.

FIG. 22 is a rear perspective view of the bathroom hygiene device 200 used in conjunction with a urinal 2202, according to the second example embodiment. FIG. 22 shows how any fluid falling from the urinal 2202 falls into the splatter guard 204 of the bathroom hygiene device 200, thereby preventing splattering of the fluid onto the floor or the individual using the urinal 2202.

Figure 23:
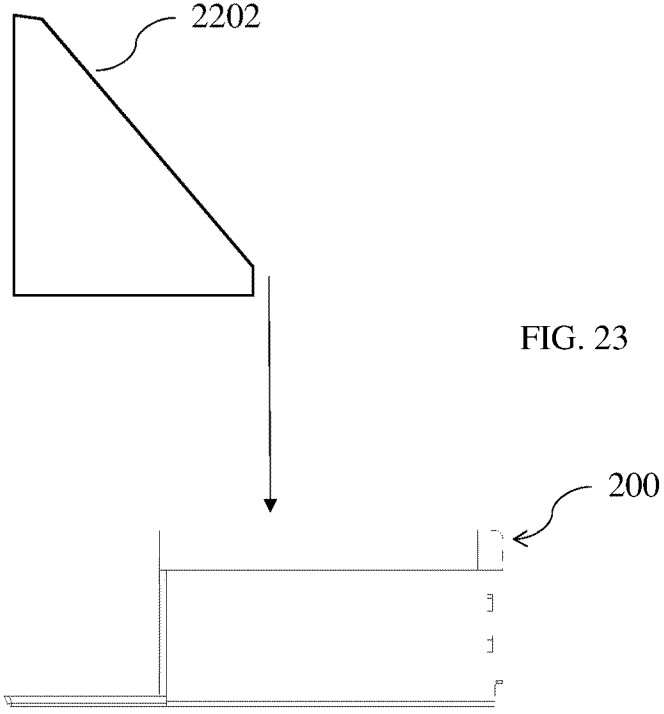
FIG. 23 is a side view of the bathroom hygiene device used in conjunction with a urinal, according to the second example embodiment.

FIG. 23 is a side view of the bathroom hygiene device 200 used in conjunction with the urinal 2202, according to the second example embodiment. FIG. 23 also shows how any fluid falling from the urinal 2202 falls into the splatter guard 204 of the bathroom hygiene device 200.

FIG. 1 is a frontal perspective view of the bathroom hygiene device 100, according to a first example embodiment. FIG. 1 shows the device 100 includes a first roller 109 configured for accepting a roll of absorbent material 112 and for rotating when pulled, so as to expel absorbent material 112 out of the roll, a second mechanized roller 110 configured for rotating upon command, so as to accept and wind up absorbent material 112 expelled from the roll, a middle planar element 102 located between the first roller and the second mechanized roller, wherein the middle planar element 102 is located adjacent to the urinal or toilet so as to catch liquid falling from the urinal or toilet, wherein the absorbent material 112 expelled from the first roller 109 is located on top of the middle planar element 102, and wherein the middle planar element 102 is configured to support the weight of an individual utilizing the urinal or toilet, a splatter guard 104 comprising an enclosure located on top of the middle planar element 102, wherein an open end of the splatter guard 104 faces the urinal or toilet, and a closed end of the splatter guard 104 faces the individual, and wherein the splatter guard 104 prevents splattering of liquid falling from the urinal or toilet onto the individual, a sensor 114 for sensing proximity of said individual, and, a processor (shown in later figures) configured for receiving a signal from the sensor 114 sensing proximity of said individual, and activating the second mechanized roller 110 to advance the roll of absorbent material 112 to place a fresh segment of absorbent material 112 from the roll on top of the middle planar element 102.

Figure 2:
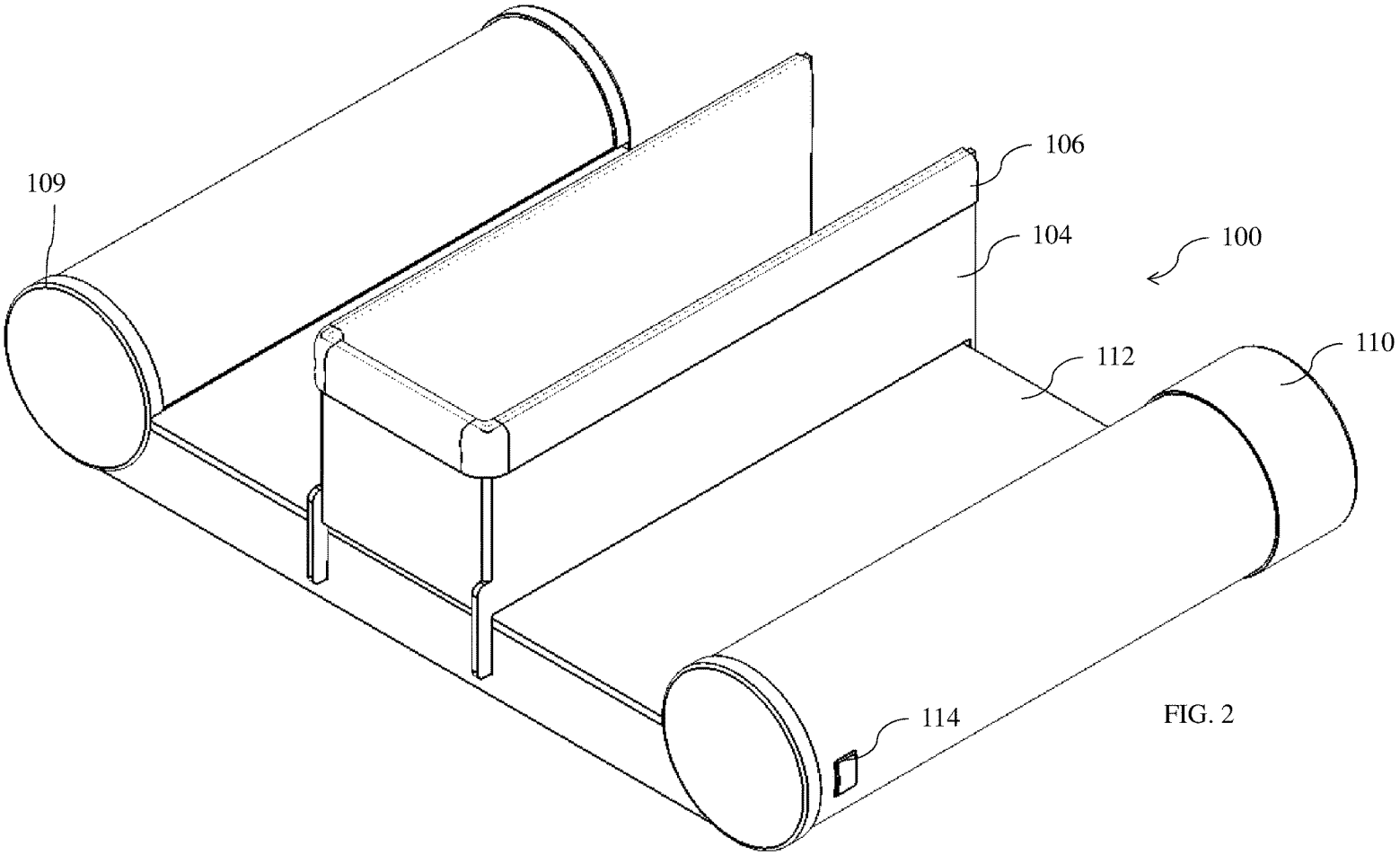
FIG. 2 is a rear perspective view of the bathroom hygiene device, according to the first example embodiment.

FIG. 2 is a rear perspective view of the bathroom hygiene device 100, according to the first example embodiment. FIG. 2 shows that the device 100 also includes a disposable and water repellant cover 106 configured for placement over and on top of the splatter guard 104, such that the cover prevents liquid falling from the urinal or toilet from contacting the splatter guard 104.

Figure 3:
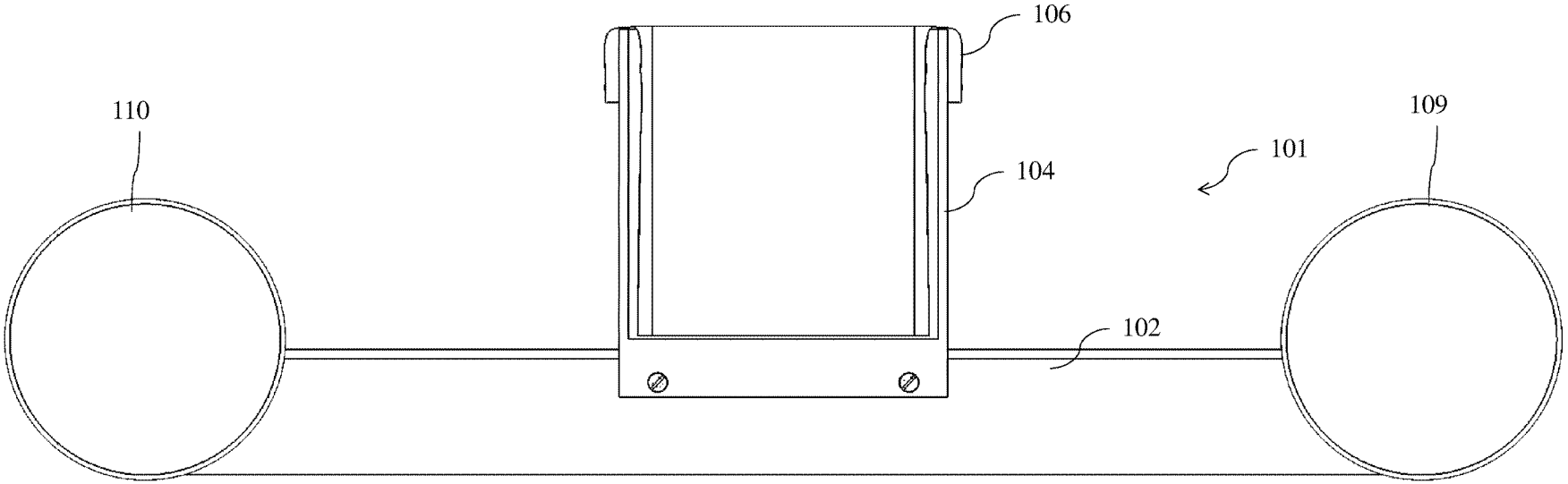
FIG. 3 is a frontal view of the bathroom hygiene device, according to the first example embodiment.

FIG. 3 is a frontal view of the bathroom hygiene device 100, according to the first example embodiment. FIG. 3 shows how the disposable and water repellant cover 106 is placed over and on top of the splatter guard 104, such that the cover prevents liquid falling from the urinal or toilet from contacting the splatter guard 104.

Figure 4:
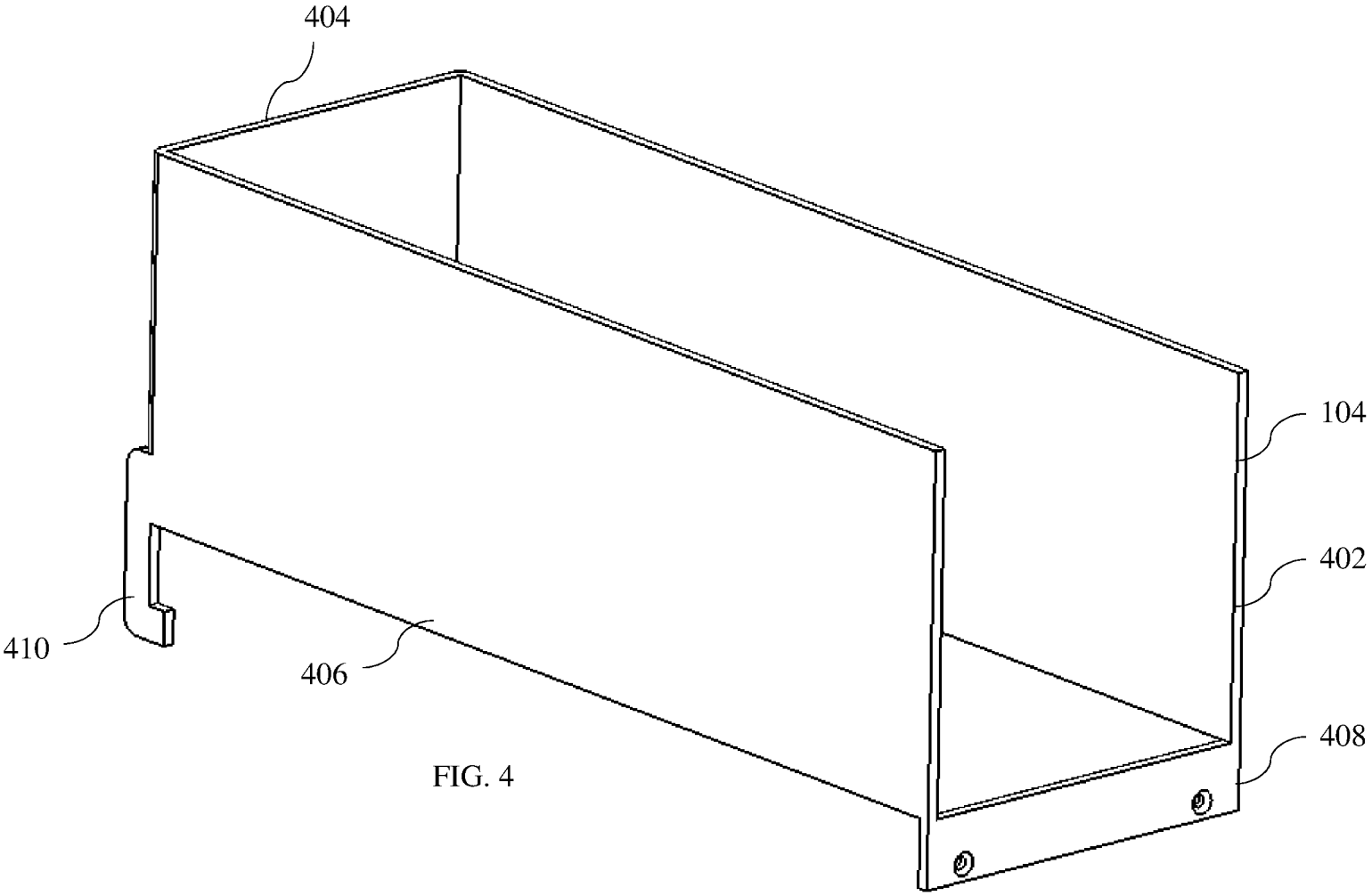
FIG. 4 is a frontal perspective view of the splatter guard of the bathroom hygiene device, according to the first example embodiment.

FIG. 4 is a frontal perspective view of the main receptacle of the bathroom hygiene device 100, according to the first example embodiment. FIG. 4 shows that the splatter guard 104 comprises three, upright rectangular walls 402, 404, 406 connected in a general U-shape, wherein an open end of the splatter guard faces the urinal or toilet, and a closed end of the splatter guard faces the individual. The splatter guard 104 may also include a planar element 408 that extends downwards and is configured for coupling with the planar element 102 at the proximal end of the splatter guard, as well as one or more hook-like protrusions 410 on the distal end of the splatter guard, wherein the protrusions are also configured for coupling with the planar element 102.

Figure 5:
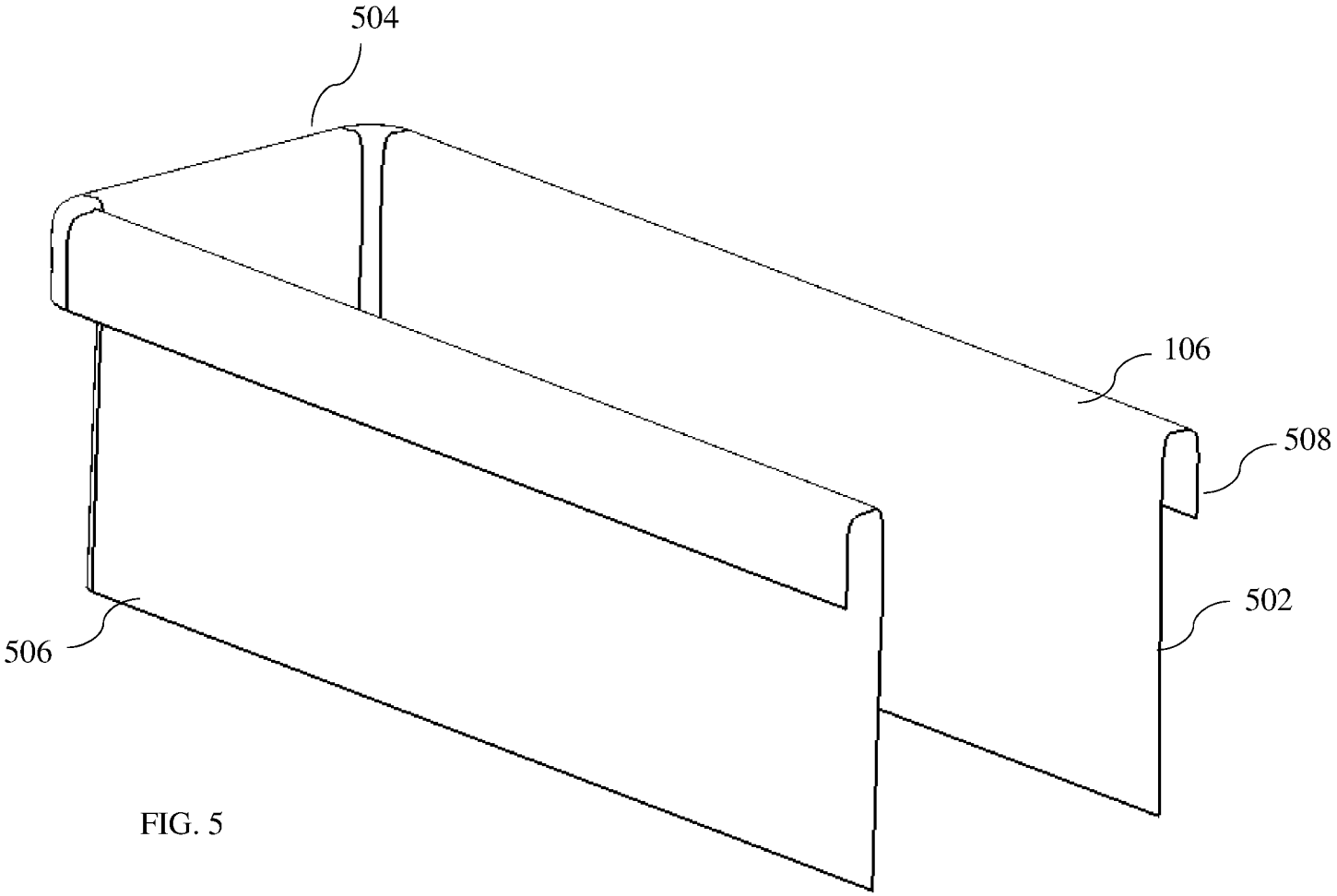
FIG. 5 is a frontal perspective view of the disposable cover for the main receptacle of the bathroom hygiene device, according to the first example embodiment.

FIG. 5 is a frontal perspective view of the cover 106 for the main receptacle or splatter guard 104 of the bathroom hygiene device 100, according to the first example embodiment. FIG. 5 shows that the cover 106 comprises three, upright rectangular walls 502, 504, 506 connected in a general U-shape, wherein an open end of the cover faces the urinal or toilet, and a closed end of the cover faces the individual. The cover 106 is configured to fit securely over and on top of the splatter guard 104. The cover 106 also includes a lip 508 that curves away from the brim of the three, upright rectangular walls 502, 504, 506 so as to completely cover the splatter guard 104 and prevent it from being contacted by fluid falling from the urinal or toilet.

Figure 6:
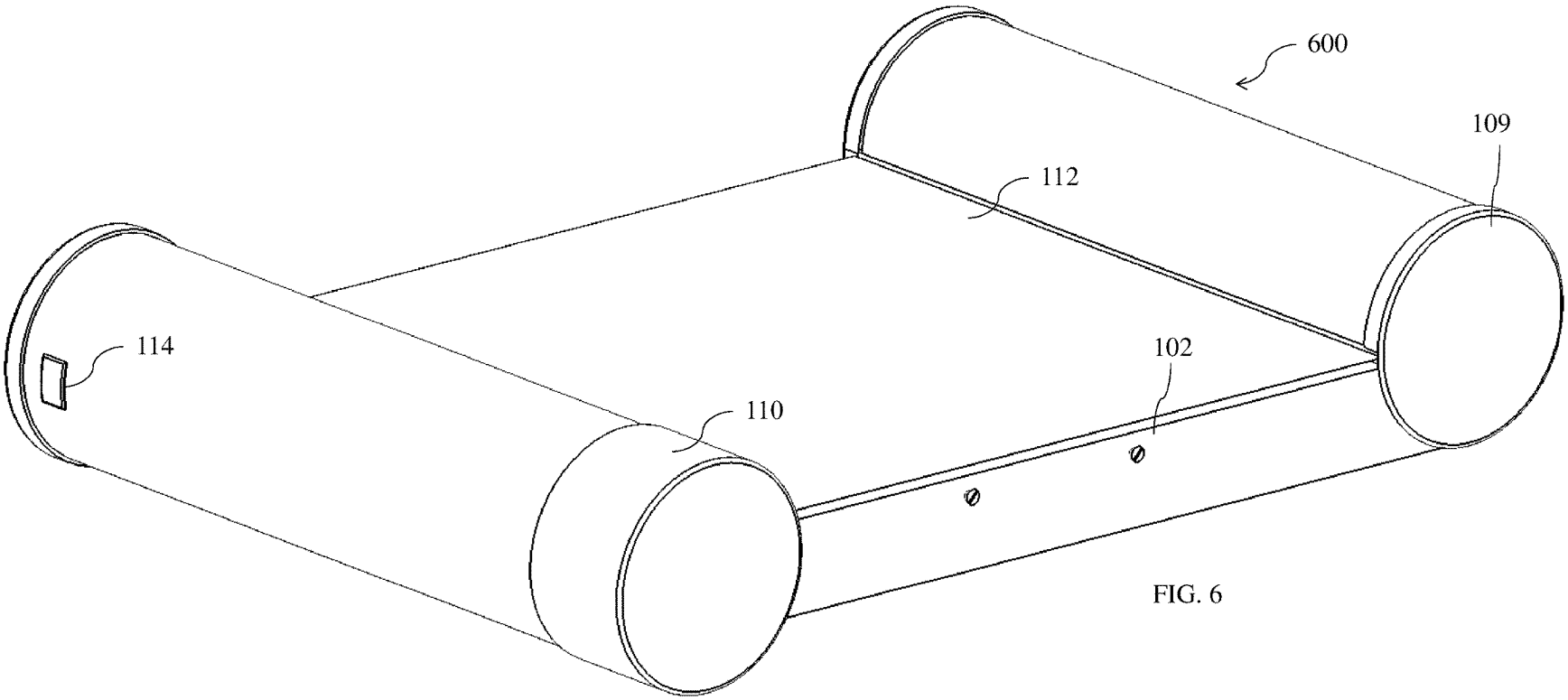
FIG. 6 is a frontal perspective view of the automated roller device for the bathroom hygiene device, according to the first example embodiment.

FIG. 6 is a frontal perspective view of the automated roller device 600 for the bathroom hygiene device 100, according to the first example embodiment. The roller device 600 includes a first roller 109 configured for accepting a roll of absorbent material 112 and for rotating when pulled, so as to expel absorbent material 112 out of the roll, a second mechanized roller 110 configured for rotating upon command, so as to accept and wind up absorbent material 112 expelled from the roll, a middle planar element 102 located between the first roller and the second mechanized roller, wherein the absorbent material 112 expelled from the first roller 109 is located on top of the middle planar element 102, and wherein the middle planar element 102 is configured to support the weight of an individual utilizing the urinal or toilet, a sensor 114 for sensing proximity of said individual, and, a processor (shown in later figures) configured for receiving a signal from the sensor 114 sensing proximity of said individual, and activating the second mechanized roller 110 to advance the roll of absorbent material 112 to place a fresh segment of absorbent material 112 from the roll on top of the middle planar element 102. The absorbent material 112 comprises a rectangular shape configured for placement on top of the middle planar element 102, such that the middle planar element 102 is completely covered by the absorbent material 112.

Figure 7:
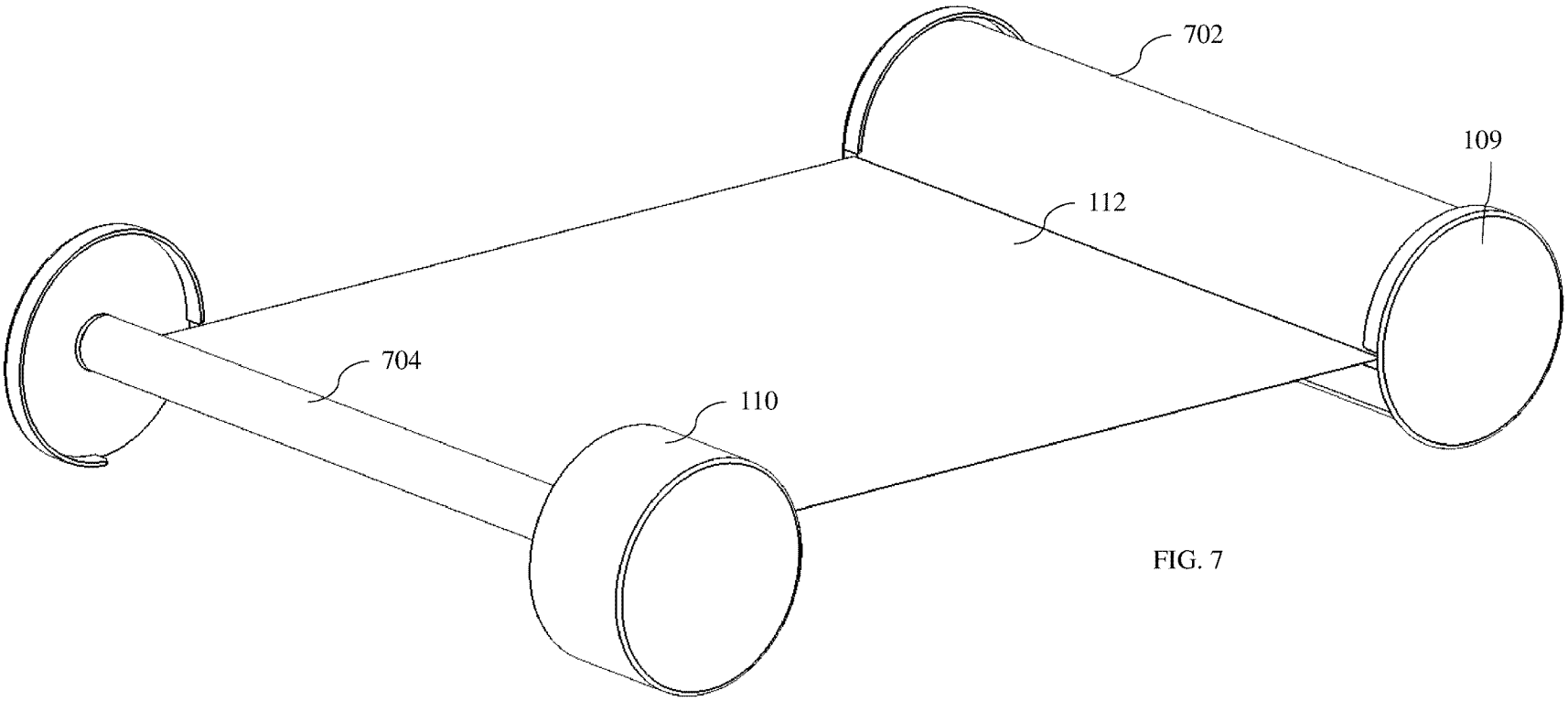
FIG. 7 is a frontal perspective view of the interior components of the automated roller device of the bathroom hygiene device, according to the first example embodiment.

FIG. 7 is a frontal perspective view of the interior components of the automated roller device 600 of the bathroom hygiene device 100, according to the first example embodiment. FIG. 7 shows that the roller device 600 includes a includes a first roller 109 configured for accepting a roll 702 of absorbent material 112 and for rotating when pulled, so as to expel absorbent material 112 out of the roll 702. FIG. 7 shows that the roller device 600 includes a includes a second mechanized roller 110, having a rod 704, and configured for rotating upon command, so as to accept and wind up absorbent material 112 expelled from the roll 702.

Figure 8:
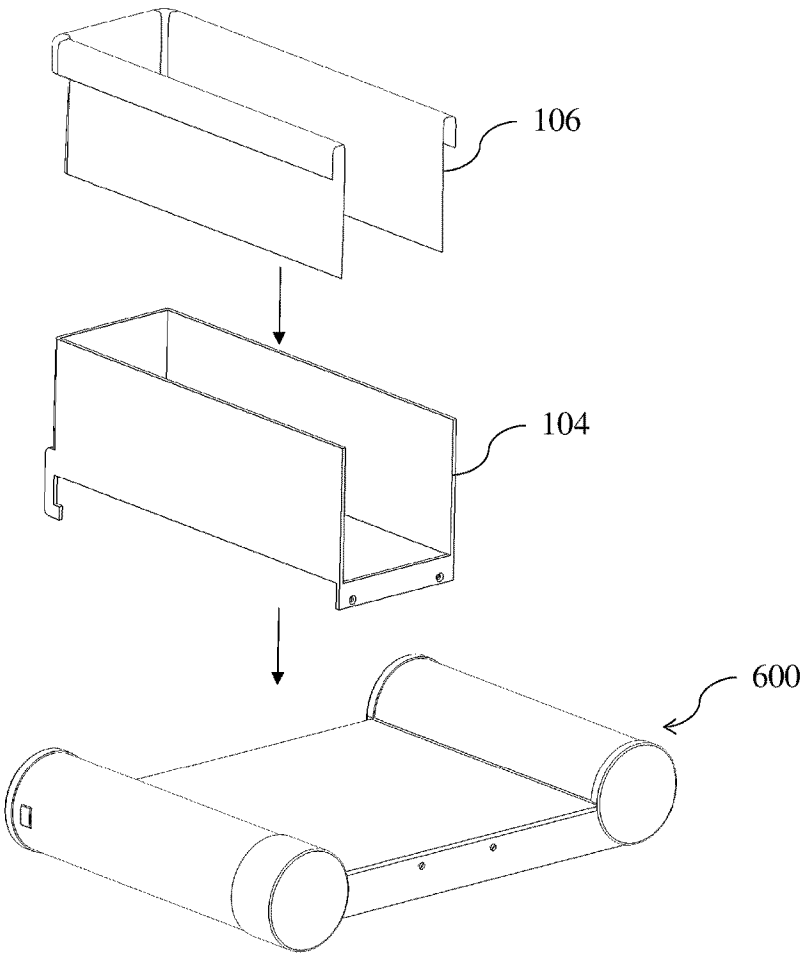
FIG. 8 is a frontal perspective exploded view of the bathroom hygiene device, according to the first example embodiment.

FIG. 8 is a frontal perspective exploded view of the bathroom hygiene device 100, according to the first example embodiment. FIG. 8 shows how the cover 106 is placed on top of and over the splatter guard 104, which is placed on top of the automated roller device 600.

Figure 9:
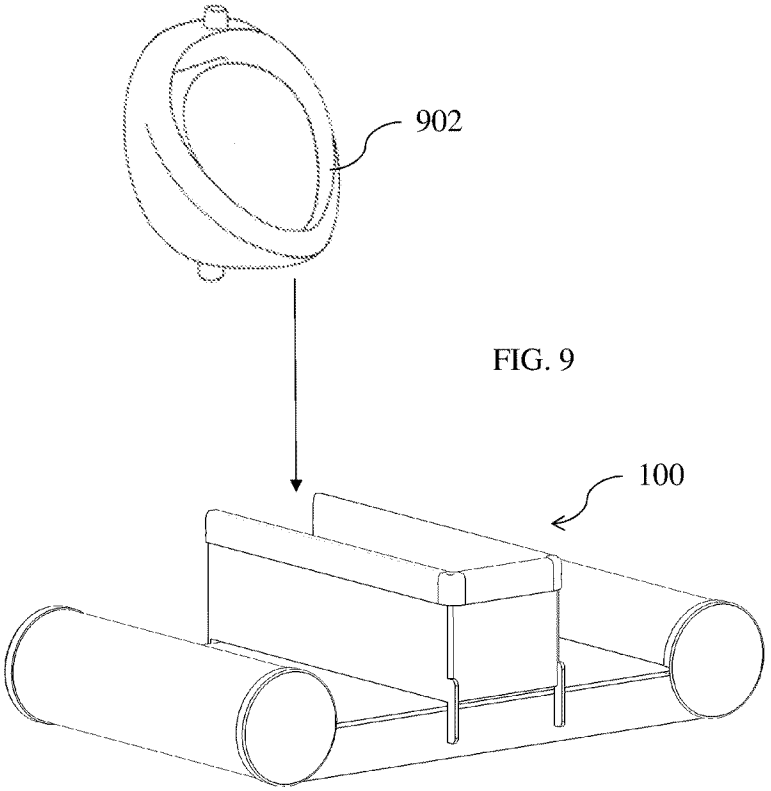
FIG. 9 is a rear perspective view of the bathroom hygiene device used in conjunction with a urinal, according to the first example embodiment.

FIG. 9 is a rear perspective view of the bathroom hygiene device 100 used in conjunction with a urinal 902, according to the first example embodiment. FIG. 9 shows how any fluid falling from the urinal 902 falls into the splatter guard 104 of the bathroom hygiene device 100, thereby preventing splattering of the fluid onto the floor or the individual using the urinal 902.

Figure 10:
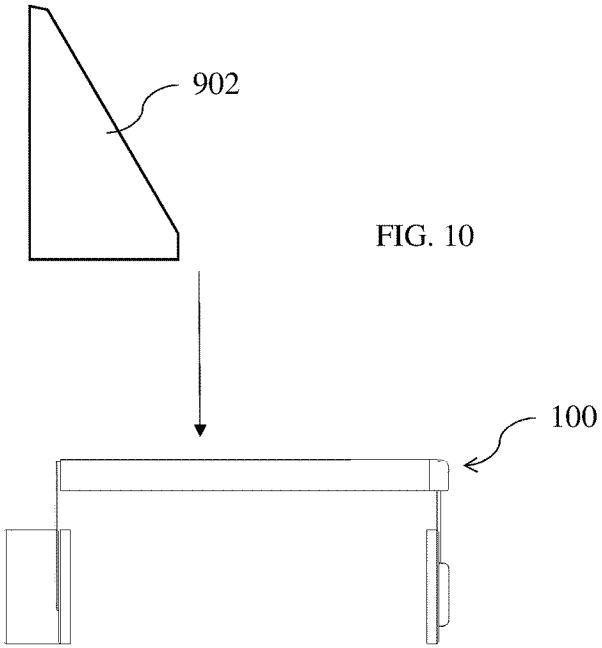
FIG. 10 is a side view of the bathroom hygiene device used in conjunction with a urinal, according to the first example embodiment.

FIG. 10 is a side view of the bathroom hygiene device 100 used in conjunction with the urinal 902, according to the first example embodiment. FIG. 10 also shows how any fluid falling from the urinal 902 falls into the splatter guard 104 of the bathroom hygiene device 100.

Devices 100, 200 and their components may be manufactured from a variety of materials including metal, such as stainless steel, titanium, aluminum or any metal alloy, rigid fabric, carbon fiber, epoxy resin, graphite, rubber, plastic or any combination of the above. Devices 100, 200 and their components may alternatively be manufactured from a synthetic man made material.

Plastic covers a range of synthetic or semi-synthetic polymerization products. Plastics are composed of organic condensation or addition polymers and may contain other substances to improve performance or economics. Plastic may comprise any one of the following forms of plastic: polyethylene, polystyrene, high impact polystyrene, polyethylene terephthalate, nylon, polypropylene, acrylonitrile butadiene styrene (ABS), bayblend and polyvinylidene chloride (PVC).

Devices 100, 200 and their components may be manufactured from a plastic compound using any variety of processes, such as injection molding, fusible core injection molding and thermoforming.

Injection molding is a manufacturing technique for making parts from thermoplastic material in production. Molten plastic is injected at high pressure into a mold, which is the inverse of the product's shape. After a product is designed by an industrial designer, molds are made by a mold-maker from metal, usually either steel or aluminum, and precision-machined to form the features of the desired part. Injection molding is widely used for manufacturing a variety of parts and is the most common method of plastic production.

The most commonly used thermoplastic materials are polystyrene, ABS or acrylonitrile butadiene styrene, nylon, polypropylene, polyethylene, and polyvinyl chloride or PVC.

Injection molding machines, also known as presses, hold the molds in which the components are shaped. Presses are rated by tonnage, which expresses the amount of clamping force that the machine can generate. This pressure keeps the mold closed during the injection process.

Molds separate into at least two halves (called the core and the cavity) to permit the plastic part to be extracted. In general, the shape of a part must not cause it to be locked into the mold. For example, sides of objects typically cannot be parallel with the direction of draw (the direction in which the core and cavity separate from each other). They are angled slightly. Pins are the most popular method of removal from the core, but air ejection, and stripper plates can also be used depending on the application. Most ejection plates are found on the moving half of the tool, but they can be placed on the fixed half.

Molds are built through two main methods: standard machining and EDM machining. Standard machining, in its conventional form, has historically been the method of building injection molds. With technological development, computer numerical control (CNC) machining became the predominant means of making more complex molds with more accurate mold details in less time than traditional methods.

The electrical discharge machining (EDM) or spark erosion process has become widely used in mold making EDM is a simple process in which a shaped electrode, usually made of copper or graphite, is very slowly lowered onto the mold surface (over a period of many hours), which is immersed in paraffin oil. A voltage applied between tool and mold causes erosion of the mold surface in the inverse shape of the electrode.

Fusible core injection molding or lost core injection molding is a specialized plastic injection molding process. It is used in the manufacture of molded components with cavities or undercuts, which would not be possible with tools having demoldable cores. The process consists of three essential steps. First, a core consisting of a low melting point metal is poured in the shape of the cavity specified for the molded component. This is inserted into the injection mold in the second step and injected with plastic. Molded component and core are both demolded and, in the third step, immersed in a heated bath to melt out the core. The bath temperature is selected to be somewhat higher than that of the core alloy's melting point, but not so that the injected part would be damaged. Induction heating of the core metal in the heated bath reduces the melt out time to a few minutes. Liquid core metal collects on the bottom of the heated bath and is usable for a new core.

Thermoforming is a manufacturing process for thermoplastic sheet or film. The sheet or film is heated between infrared, natural gas, or other heaters to its forming temperature. Then it is stretched over or into a temperature-controlled, single-surface mold. Cast or machined aluminum is the most common mold material, although epoxy and wood tooling are sometime used for low volume production. The sheet is held against the mold surface unit until cooled. The formed part is then trimmed from the sheet. The trimmed material is usually reground, mixed with virgin plastic, and reprocessed into a usable sheet. There are several categories of thermoforming, including vacuum forming, pressure forming, twin-sheet forming, drape forming, free blowing, and simple sheet bending.

FIG. 24 is a block diagram of a system including an example computing device 2400 and other computing devices. Consistent with the embodiments described herein, the aforementioned actions performed by devices 100, 200, as well as any processors included therein, may be implemented in a computing device, such as the computing device 2400 of FIG. 24. Any suitable combination of hardware, software, or firmware may be used to implement the computing device 2400. The aforementioned system, device, and processors are examples and other systems, devices, and processors may comprise the aforementioned computing device. Furthermore, computing device 2400 may comprise an operating environment for devices and systems, as described above.

With reference to FIG. 24, a system consistent with an embodiment may include a plurality of computing devices, such as computing device 2400. In a basic configuration, computing device 2400 may include at least one processing unit 2402 and a system memory 2404. Depending on the configuration and type of computing device, system memory 2404 may comprise, but is not limited to, volatile (e.g. random access memory (RAM)), non-volatile (e.g. read-only memory (ROM)), flash memory, or any combination or memory. System memory 2404 may include operating system 2405, and one or more programming modules 2406. Operating system 2405, for example, may be suitable for controlling computing device 2400's operation. In one embodiment, programming modules 2406 may include, for example, a program module 2407 for executing the actions of the device. Furthermore, embodiments may be practiced in conjunction with a graphics library, other operating systems, or any other application program and is not limited to any particular application or system. This basic configuration is illustrated in FIG. 24 by those components within a dashed line 2420.

Computing device 2400 may have additional features or functionality. For example, computing device 2400 may also include additional data storage devices (removable and/or non-removable) such as, for example, magnetic disks, optical disks, or tape. Such additional storage is illustrated in FIG. 24 by a removable storage 2409 and a non-removable storage 2410. Computer storage media may include volatile and nonvolatile, removable and non-removable media implemented in any method or technology for storage of information, such as computer readable instructions, data structures, program modules, or other data. System memory 2404, removable storage 2409, and non-removable storage 2410 are all computer storage media examples (i.e. memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 2400. Any such computer storage media may be part of device 2400. Computing device 2400 may also have input device(s) 2412 such as a keyboard, a mouse, a pen, a sound input device, a camera, a touch input device, etc. Output device(s) 2414 such as a display, speakers, a printer, etc. may also be included. The aforementioned devices are only examples, and other devices may be added or substituted.

Computing device 2400 may also contain a communication connection 2416 that may allow device 2400 to communicate with other computing devices 2418, such as over a network in a distributed computing environment, for example, an intranet or the Internet. Communication connection 2416 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both computer storage media and communication media.

As stated above, a number of program modules and data files may be stored in system memory 2404, including operating system 2405. While executing on processing unit 2402, programming modules 2406 (e.g. program module 2407) may perform computing processes. The aforementioned processes are examples, and processing unit 2402 may perform other processes. Other programming modules that may be used in accordance with embodiments may include electronic mail and contacts applications, word processing applications, spreadsheet applications, database applications, slide presentation applications, drawing or computer-aided application programs, etc.

Generally, consistent with embodiments herein, program modules may include routines, programs, components, data structures, and other types of structures that may perform particular tasks or that may implement particular abstract data types. Moreover, embodiments herein may be practiced with other computer system configurations, including hand-held devices, multiprocessor systems, microprocessor-based or programmable consumer electronics, minicomputers, mainframe computers, and the like. Embodiments herein may also be practiced in distributed computing environments where tasks are performed by remote processing devices that are linked through a communications network. In a distributed computing environment, program modules may be located in both local and remote memory storage devices.

Furthermore, embodiments herein may be practiced in an electrical circuit comprising discrete electronic elements, packaged or integrated electronic chips containing logic gates, a circuit utilizing a microprocessor, or on a single chip (such as a System on Chip) containing electronic elements or microprocessors. Embodiments herein may also be practiced using other technologies capable of performing logical operations such as, for example, AND, OR, and NOT, including but not limited to mechanical, optical, fluidic, and quantum technologies. In addition, embodiments herein may be practiced within a general purpose computer or in any other circuits or systems.

Embodiments herein, for example, are described above with reference to block diagrams and/or operational illustrations of methods, systems, and computer program products according to embodiments herein. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments have been described, other embodiments may exist. Furthermore, although embodiments have been described as being associated with data stored in memory and other storage mediums, data can also be stored on or read from other types of computer-readable media, such as secondary storage devices, like hard disks, floppy disks, or a CD-ROM, or other forms of RAM or ROM. Further, the disclosed methods' stages may be modified in any manner, including by reordering stages and/or inserting or deleting stages, without departing from the claimed subject matter.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An apparatus for reducing or eliminating splattering of fluid at a urinal or toilet, the apparatus comprising:

a) a roll of absorbent material configured for absorbing liquid falling from the urinal or toilet;

b) a first roller configured for accepting the roll of absorbent material and for rotating when pulled, so as to expel absorbent material out of the roll;

c) a second mechanized roller configured for rotating upon command, so as to accept and wind up absorbent material expelled from the roll;

d) a middle planar element located between the first roller and the second mechanized roller, wherein the middle planar element is located adjacent to the urinal or toilet so as to catch liquid falling from the urinal or toilet, wherein the absorbent material expelled from the first roller is located on top of the middle planar element, and wherein the middle planar element is configured to support the weight of an individual utilizing the urinal or toilet;

e) a splatter guard comprising an enclosure located on top of the middle planar element, wherein an open end of the splatter guard faces the urinal or toilet, and a closed end of the splatter guard faces the individual, and wherein the splatter guard prevents splattering of liquid falling from the urinal or toilet onto the individual;

f) a sensor for sensing proximity of said individual; and g) a processor configured for receiving a signal from the sensor sensing proximity of said individual, and activating the second mechanized roller to advance the roll of absorbent material to place a fresh segment of absorbent material from the roll on top of the middle planar element.

2. The apparatus of claim 1, further comprising a disposable and water repellant cover configured for placement over and on top of the splatter guard, such that the cover prevents liquid falling from the urinal or toilet from contacting the splatter guard.

3. The apparatus of claim 2, wherein the disposable and water repellant cover is composed of a plastic or synthetic man made fiber material.

4. The apparatus of claim 3, wherein the middle planar element comprises a rectangular shape.

5. The apparatus of claim 4, wherein the middle planar element is composed of a plastic material.

6. The apparatus of claim 5, wherein the splatter guard comprises three, upright rectangular walls connected in a U-shape, wherein an open end of the splatter guard faces the urinal or toilet, and a closed end of the splatter guard faces the individual.

7. The apparatus of claim 6, wherein the splatter guard is composed of a plastic material.

8. The apparatus of claim 7, wherein the absorbent material is configured for placement on the middle planar element, such that the middle planar element is completely covered by the absorbent material.

9. The apparatus of claim 8, wherein the disposable and water repellant cover comprises three, upright rectangular walls connected in a U-shape, wherein an open end of the cover faces the urinal or toilet, and a closed end of the cover faces the individual.

* * * * *